US007594535B2

(12) United States Patent
Otsuka et al.

(10) Patent No.: US 7,594,535 B2
(45) Date of Patent: Sep. 29, 2009

(54) TWIN ROLL CASTER, AND EQUIPMENT AND METHOD FOR OPERATING THE SAME

(75) Inventors: Hiroyuki Otsuka, Tokyo (JP); Katsumi Nakayama, Tokyo (JP); Shiro Osada, Tokyo (JP); Hisahiko Fukase, Tokyo (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 11/458,446

(22) Filed: Jul. 19, 2006

(65) Prior Publication Data

US 2007/0017651 A1 Jan. 25, 2007

(30) Foreign Application Priority Data

Jul. 25, 2005 (JP) ..... 2005-213966

(51) Int. Cl.
*B22D 11/06* (2006.01)
*B22D 11/124* (2006.01)

(52) U.S. Cl. ..... 164/480; 164/428; 164/448

(58) Field of Classification Search ..... 164/480, 164/448, 428; 492/45, 46, 47
See application file for complete search history.

(56) References Cited

U.S. PATENT DOCUMENTS

| | | | | |
|---|---|---|---|---|
| 3,038,219 | A | 6/1962 | Hudson | |
| 4,842,040 | A | 6/1989 | Bibler et al. | |
| 4,944,342 | A | 7/1990 | Lauener | |
| 5,484,370 | A * | 1/1996 | Jenke et al. | 492/4 |
| 5,839,501 | A * | 11/1998 | Delassus et al. | 164/428 |
| 6,241,002 | B1 * | 6/2001 | Russell et al. | 164/428 |
| 6,474,402 | B1 | 11/2002 | Sauer et al. | |
| 6,883,585 | B2 | 4/2005 | Poloni et al. | |
| 6,892,793 | B2 | 5/2005 | Liu et al. | |
| 2002/0170701 | A1 | 11/2002 | Yamamoto et al. | |
| 2004/0129403 | A1 | 7/2004 | Liu et al. | |
| 2005/0155746 | A1 * | 7/2005 | Chen | 165/104.33 |

FOREIGN PATENT DOCUMENTS

| | | |
|---|---|---|
| EP | 0499562 | 8/1992 |
| EP | 0543531 | 5/1993 |
| GB | 2327630 | 2/1999 |
| WO | 9211959 | 7/1992 |
| WO | 9319784 | * 10/1993 |
| WO | WO 93/19874 A1 | * 10/1993 |
| WO | 2007/056801 | 5/2007 |

OTHER PUBLICATIONS

International Search Report for PCT/AU2006/001038.
Written Opinion for PCT/AU2006/001038.
International Search Report for PCT/AU2006/001706.
First Office Action in CN200680027244.2, dated Apr. 3, 2009.

* cited by examiner

*Primary Examiner*—Kevin P Kerns
(74) *Attorney, Agent, or Firm*—Han Loeser & Parks LLP; Arland T. Stein

(57) ABSTRACT

A twin roll caster with the casting roll having longitudinal cooling channels extending from one shoulder portion, adjacent a side dam, to the other shoulder portion, adjacent the opposite side dam. The molten metal pool is confined by side dams that may engage the end surfaces of the shoulder portions.

25 Claims, 7 Drawing Sheets

TWIN ROLL CASTER, AND EQUIPMENT AND METHOD FOR OPERATING THE SAME

BACKGROUND OF THE INVENTION

This invention relates generally to twin roll casters, and more particularly to casting rolls for a twin roll caster.

The twin roll method of continuous casting thin metal strip from molten metal between a pair of counter rotating casting rolls and through the gap between the rolls is known for directly producing strip from molten metal. FIGS. 6 and 7 show an example of a prior art continuous casting machine, the casting rolls 2 are in contact with side dams 1 at the circumferential end surfaces of the casting rolls 2, and having hollow stub shafts 3 that axially engage the two ends of the casting rolls 2 (see for example U.S. Pat. No. 6,241,002).

The two end portions of the casting rolls 2 are smaller than the central portions, and are shaped as to come into contact with the side dams 1. In the continuous casting machine, the pair of casting rolls 2 are disposed lateral to each other in such a manner that the casting roll gap may be adjusted according to the thickness of the strip S that is to be manufactured. The side dams 1 are respectively in contact with the end surfaces of the central portion of greater diameter of the casting rolls 2 containing the molten metal M. The speed and direction of revolution of the casting rolls are set such that the outer circumferential surfaces should move towards the casting roll gap at the same speed.

Radially below and spaced from the position of the side dams, the casting rolls 2 have in the past had internally a plurality of axially extending cooling channels 4 positioned equidistantly circumferentially, and a plurality of radially extending cooling channels 5 connected with the ends of the cooling channels 4. The cooling channels 4 extend from one end of the casting rolls to the other end of the casting rolls radially below the position of the side dams. Bolts 7 or plugs 6 in the ends served as plugs to close the ends of the cooling channels 4. The radial cooling channels 5 extend from an inner circumferential surface of the casting roll at right angles to the cooling channels 4.

Radial cooling channels 8 pass through the hollow shaft 3 to allow cooling water W to flow through one hollow shaft 3 into one radial cooling channels 5, then into cooling channels 4, corresponding radial cooling channels 5 at the other end of the casting roll 2, and finally into the interior of the other hollow shaft 3.

In such a continuous casting machine, heat is removed by cooling water W flowing through the radial cooling channels 5 and the longitudinal cooling channels 4 while molten metal M is poured into the space confined by the side dams 1 and the casting rolls 2 forming a pool of molten metal M above the nip between the casting rolls. As the casting rolls rotate, the metal that is being cooled on the outer circumferential surfaces of the casting rolls 2 forms solidified shells, and strip S is sent downwards from the casting roll gap. The rate of cooling of the molten metal is however limited by the heat conductivity from the circumferential surfaces to the cooling channels.

Thus, it is apparent that it would be advantageous to provide an alternative apparatus and method to provide more efficient casting of melt strip. Accordingly, a suitable alternative is provided including features more fully disclosed hereinafter.

SUMMARY OF THE INVENTION

An apparatus and method are disclosed for casting metal strip having a pair of laterally positioned novel casting rolls forming a nip between them. A molten metal supply system delivers molten metal into the nip between the casting rolls and forms a casting pool of molten metal supported on the casting rolls immediately above the nip. A pair of side dams, one at each end of the pair of casting rolls, confine the pool of molten metal and abut the axial end surfaces of the casting rolls.

Each casting roll has a cylindrical body with axial end surfaces. Each casting roll has a stepped cylindrical body where a cylindrical central portion has a larger outer diameter than adjacent cylindrical end portions that extend axially from each end of the central portion at a stepped shoulder portion. A plurality of longitudinal cooling passages extends from one axial end to the other axial end of the casting roll of the central portion at the stepped shoulder portion. The shoulder surfaces between the cylindrical central portion and the adjacent end portions have a plurality of circumferentially spaced cooling apertures therein with longitudinal cooling passages extending through the cylindrical central portion and terminating in one of the cooling aperture in the shoulder surfaces. Each cooling aperture is sealed by an enclosure. Each shoulder surface with the cooling apertures therein is capable of engaging a pool confining side dam.

The longitudinal cooling passages are closed by plugs. Further, radial cooling passages extend from a casting roll inner periphery and connect to a longitudinal cooling passage. Part of a radial cooling passage may extend axially towards the longitudinal cooling passages In one embodiment, the plugs have a closed end and a hollow interior that opens into the longitudinal cooling passages. The plugs may also have a side aperture that connects with the radial cooling passages. The plugs may be threaded into the cooling passages and may also have a heat-conducting grease between the plugs and the cooling passages.

In another embodiment, the plugs are disked-shaped. Snap-rings may be used to retain the plugs in place.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
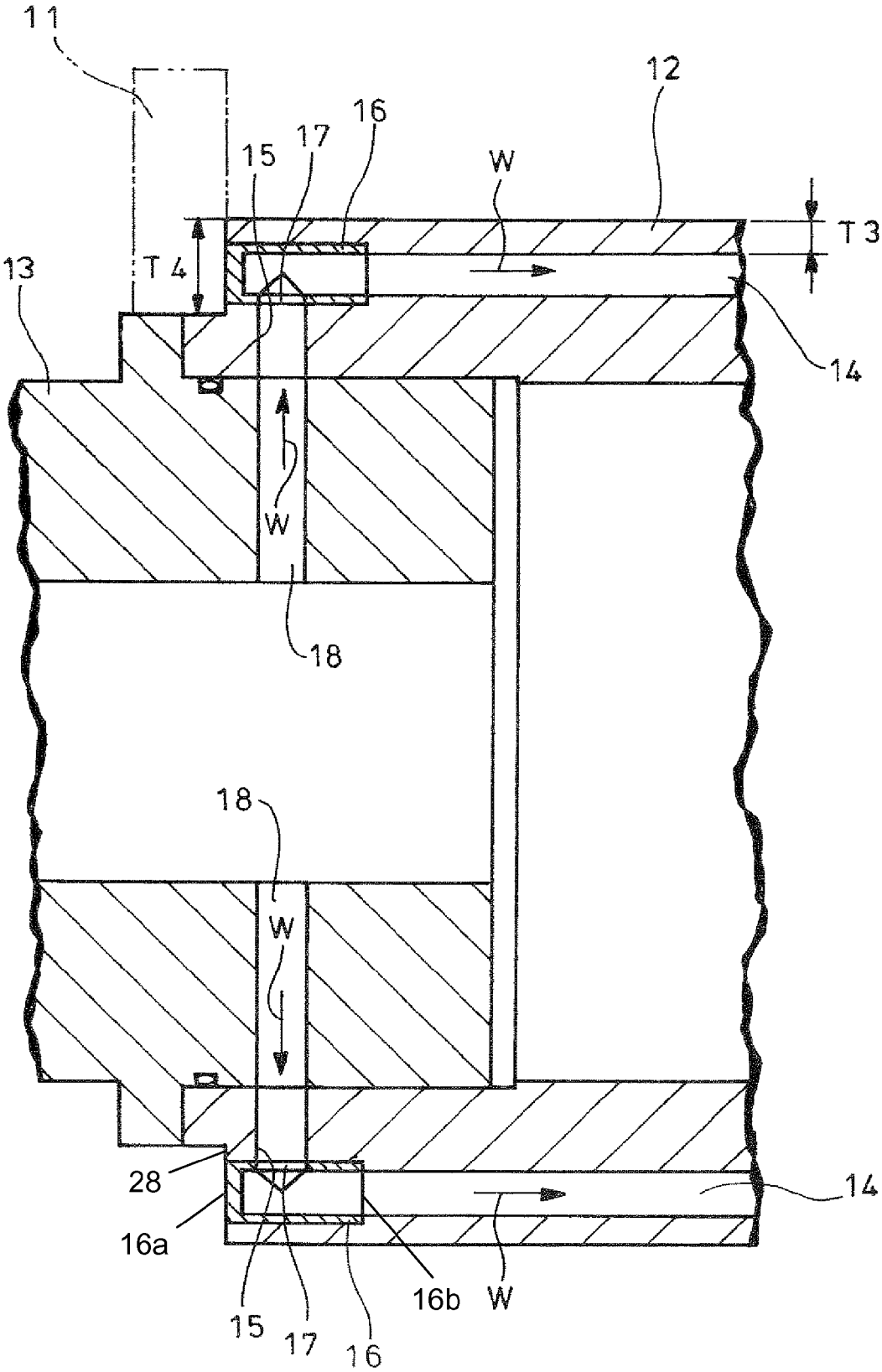
FIG. 1 is a schematic drawing showing a vertical cross section of one embodiment of a continuous casting machine.

Shown in FIGS. 1 through 5 are cylindrical casting rolls with a central portion and shoulder portions adjacent side dams. The casting rolls have longitudinal cooling channels extending through each of the central portions of the casting rolls from one shoulder portion where the side dam is positioned to the other shoulder portion where the other side dam is positioned. Radial cooling channels pass through each of the casting rolls from inner circumferential surfaces of the casting rolls at positions that are close to the surfaces of the shoulder portions of the casting rolls to communicate with the longitudinal cooling channels. Cylindrical plugs, with closed base ends, engage the ends of longitudinal cooling channels with an open interior end of the plugs facing inwards towards the centers of the longitudinal cooling channels. The plugs include through orifices linking the longitudinal cooling channels and the radial cooling channels, whereby cooling water flows sequentially through a radial cooling channel, a longitudinal cooling channel, and another radial cooling channel at the opposite end of the casting roll.

Also disclosed are cylindrical casting rolls with axial end surfaces contacting the side dams, having longitudinal cooling channels that extend through the casting roll from the surface at the end of the casting roll in contact with the side dams to the surface of the casting roll at the other end also in contact with the side dams. Radial cooling channels extend through each of the casting rolls from an inner circumferential surface of the casting rolls close to the end surfaces of the casting rolls and connect with the longitudinal cooling channels. Cylindrical plugs engage the end parts of the longitudinal channels, whereby cooling water flows sequentially through a radial cooling channel, a longitudinal cooling channel, and another radial cooling channel at the opposite end of the casting roll.

Furthermore, also disclosed are cylindrical casting rolls whose shoulder portions are adjacent side dams, and having longitudinal cooling channels extending through the end surface adjacent the side dam at one end of the casting roll to and through the end surface at the other end of the casting rolls adjacent the side dam. Radial cooling channels extend through each of the casting rolls from the inner circumferential surfaces in the vicinity of the casting roll end towards the casting roll end surfaces and communicate with the longitudinal cooling channels. Plugs with end surfaces formed into concave hollowed out portions and with the concave portions being directed inwards towards the centers engage the end parts of the longitudinal cooling channels, whereby cooling water flows in sequence through a radial cooling channel, a longitudinal cooling channel, and another radial cooling channel at the opposite end of the casting roll.

In other words, the longitudinal cooling channels are formed to extend from the first end surface of the shoulder portion of the casting rolls, adjacent a first side dam, to the second end surface of the shoulder portion of the casting rolls, adjacent a second side dam, allowing the distance between the outer circumferential surface of the casting rolls and the longitudinal cooling channels to be less than with cooled casting rolls in the past. As a result, the heat can be much more efficiently transferred from the molten metal in a casting pool to the cooling water in the casting roll.

Moreover, the radial cooling channels that extend from the inner circumferential surfaces of the casting rolls to the longitudinal cooling channels are positioned near the end surfaces of the casting rolls, with cooling water flowing through orifices in the cylindrical plugs and into the interior of the cylindrical plugs engaged with the ends of the longitudinal cooling channels.

Alternatively, cooling water may be introduced through cylindrical plugs attached to the end of the longitudinal cooling channels. As a further alternative, cooling water may flow through hollowed out portions of the plugs.

The novel casting rolls of the present invention provide the following effects.

(1) Because the longitudinal cooling channels extend through each of the casting rolls from the positions at the end of the shoulder portions, adjacent the side dams, to the positions at the other end of the shoulder portions, adjacent the other side dam, the distance between the longitudinal cooling channels and the outer circumferential surfaces of the casting rolls is small, and the outer circumferential surfaces of the casting rolls are more efficiently cooled.

(2) Because the cylindrical plugs engage the end parts of the longitudinal cooling channels and the cooling water is caused to flow continuously through the interiors of the plugs, the end portions of the outer circumferential surfaces in the vicinities of the plugs, the casting rolls are more efficiently cooled.

(3) Because the cylindrical plugs engage the end parts of the longitudinal cooling channels and the cooling water may be, if desired, in direct contact with the inner circumferential surfaces of the end portions of the longitudinal cooling channels, the end portions of the outer circumferential surfaces in the vicinity of the ends of the casting rolls are more efficiently cooled.

(4) Because hollowed out portions are formed in the plugs that engage the ends of the longitudinal cooling channels, and the radial cooling channels that extend from near the ends of the inner circumferential surfaces of the casting rolls to the end surfaces of the casting rolls, and cooling water is caused to flow through the hollowed out portions of the plugs, the end portions of the outer circumferential surfaces of the casting rolls are more efficiently cooled through the plugs.

(5) Because of the enhanced cooling of the outer circumferential surfaces of the casting rolls, the speed of the casting rolls may be increased and the productivity of cast strip may be increased.

(6) In addition, because of the enhanced cooling of the outer circumferential surfaces of the casting rolls, additional thickness of metal between the longitudinal cooling channels and the outer circumferential surfaces of the casting rolls can be provided for casting roll maintenance. Periodically, the surfaces of the casting rolls require machining to maintain the surfaces. The additional thickness of metal over the longitudinal cooling channels allows the casting roll described hereinto be re-machined more times, thereby extending the casting roll life. In one embodiment, the thickness of the casting roll available for machining increased from about 7.5 mm to about 8.5 to 10 mm while maintaining the increased cooling efficiency of the disclosed casting rolls.

Figure 2:
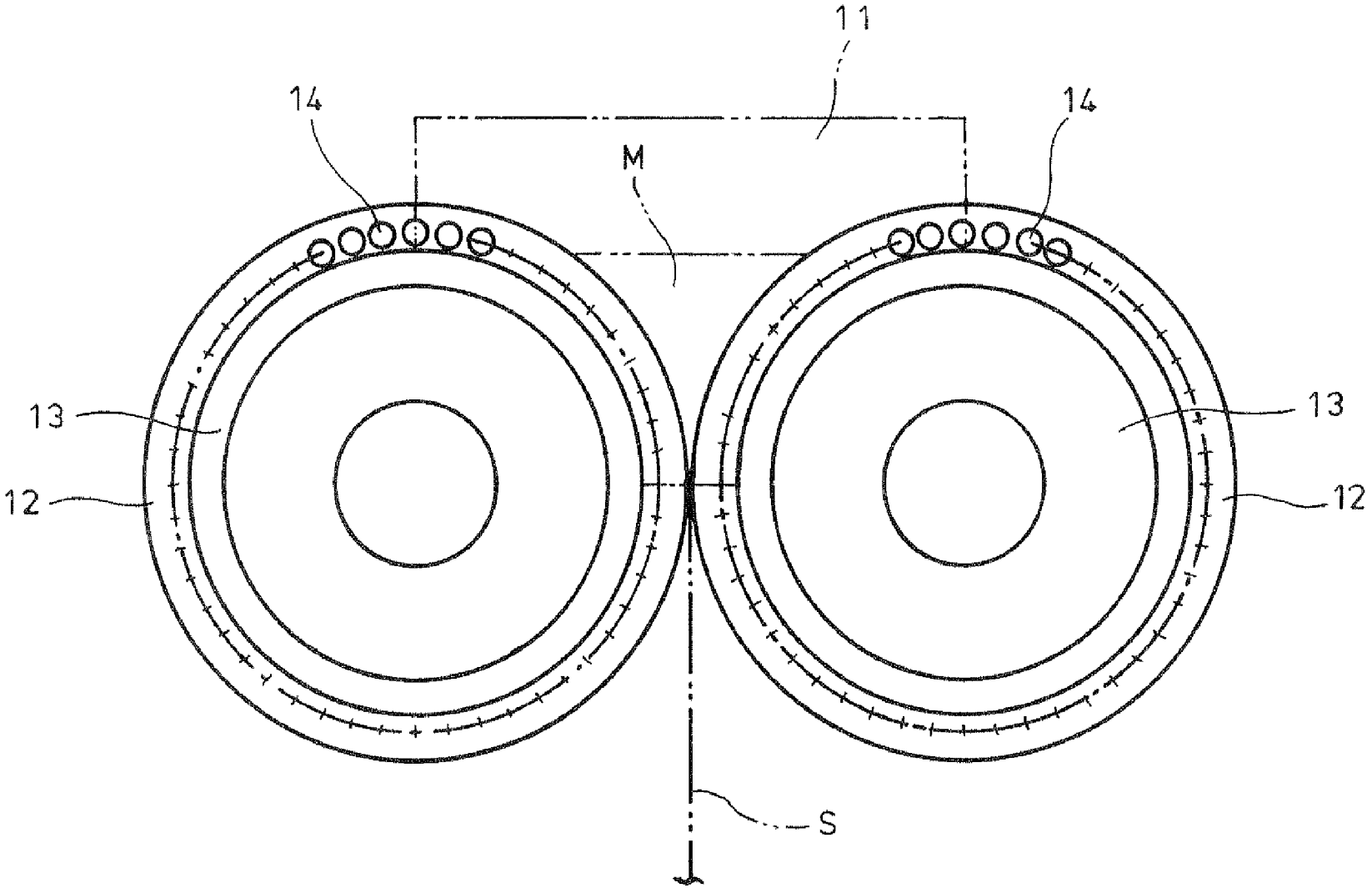
FIG. 2 is a schematic drawing showing an axial view of the casting rolls and stub shafts shown in FIG. 1.

FIGS. 1 and 2 show a continuous caster with the disclosed novel casting rolls disclosed herein. Such casting machines having casting rolls 12, the outer diameters of which are greater at the central portions than at the shoulder portions 28 at the ends. The end surfaces of the central portions whose outer diameters are greater at the shoulder portions 28 may be in contact with side dams 11. The hollow stub shafts 13 axially engage the two end portions of the casting rolls 12 have diameters similar to the outer diameters of the two end portions of the casting rolls 12 at the shoulders.

Longitudinal cooling channels 14 pass through the casting roll 12 from the end surface 28 of the larger diameter portion of one casting roll end adjacent the first side dam 11 to the other end surface (not shown) of the larger diameter portion of the casting roll end adjacent the other side dam 11. Radial cooling channels 15 extend radially through the casting roll 12 from an inner circumferential surface of the casting roll near the end surface or shoulder 28 of the casting roll 12 and connect with the longitudinal cooling channels 14.

The longitudinal cooling channels 14 may be disposed substantially equidistantly circumferentially in the casting roll 12

Furthermore, cylindrical plugs 16, with a closed outer end 16*a* close both ends of the longitudinal cooling channels 14. A hollow open end 16*b* of the plugs 16 faces towards the center of the longitudinal cooling channels 14.

Apertures 17 are formed diametrically through side of plugs 16 and connect with the longitudinal cooling channels 14 via hollow open ends 16*b*. The outer surface of the plugs 16 can be threaded to attach plugs 16 to the longitudinal cooling channels 14. O rings or other sealing materials may be used to seal plugs 16 to the longitudinal cooling channels.

When the plugs 16 are threaded into cooling channels 14, they may be coated with heat-conducting grease, such that heat-conducting grease is interposed between the outer circumferential surfaces of the plugs 16 and the inner circumferential surfaces of the longitudinal cooling channels.

Plug 16 is hollow and a radial cooling channel 18 extends from an inner circumferential surface of stub shaft 13 in such a manner that cooling water W flows continuously in sequence of through first radial cooling channel 18, into hollow plug 16 through aperture 17, then into longitudinal cooling channel 14, into hollow plug 16 at the opposite end of cooling channel 14, through aperture 17 and into the other radial cooling channel 18 and back to the hollow interior of stub shaft 13.

Alternatively, plug 16 may not include aperture 17 with the radial cooling channel 18 extending into cooling channel 14.

Moreover, in the machining of the base end surface of the plug 16 and the end surface 28, the plug 16 may be inserted with the closed end 16*a* recessed below surface 28. Then the end surface 28 may be finished until it is flush with the base end surface 16*a*. Or the plug 16 may be inserted such that the base end surface 16*a* protrudes from the longitudinal cooling channels 14, and then the plug 16 and the end surface 28 are both machined until both are flush.

In the continuous casting machine, the pair of casting rolls 12, stub shafts 13 and plugs 16 are positioned laterally to each other, and in such a manner that the casting roll gap may be adjusted according to the thickness of the strip S that is to be manufactured. The side dams 11 may be respectively in contact with the first end surface 28 and the other end surface 28 containing plugs 16.

In such continuous caster, heat is removed from the casting rolls 12 by cooling water W flowing through the radial cooling channels 15 and the longitudinal cooling channels 14 while molten metal is poured into the space above the nip confined by the side dams 11 and the casting rolls 12 to form a casting pool of molten metal M. As the casting rolls rotated, the metal that has been cooled by the outer circumferential surfaces of the casting rolls 12 forming solidified shells, and forming strip S at the nip sent downwards from the casting roll gap.

The longitudinal cooling channels 14 extend from the first end surface 28 of the casting rolls 12 that may be in contact with the first side dam 11 to the second end surface 28 of the casting rolls 12 that may be in contact with the second side dams 11. Hence it is possible to provide a small gap T3 between the longitudinal cooling channels 14 and the outer circumferential surfaces of the casting rolls 12, while maintaining contact T4 of the side dams 11 with the end surfaces of the portions of casting rolls 12 that are of greater diameter at the shoulder portions.

Thus the cooling water W passes through the longitudinal channels of the casting rolls 12 can effectively cool the outer circumferential surfaces of the casting rolls 12.

Furthermore, an embodiment is provided in which the cooling water W flows into the interiors of the cylindrical plugs 16 through apertures 17 from the radial cooling channels 15 positioned near the end surfaces 28. The outer circumferential surfaces of the casting rolls 12 near end surfaces 28 are cooled more efficiently because heat conducting grease is interposed between the outer side surfaces of the plugs 16 and the inner side surfaces of the longitudinal cooling channels 14.

In this manner, in the casting rolls shown in FIG. 1 and FIG. 2, the surface temperature of the outer circumferential surfaces of the casting rolls 12 are reduced, and the speed of the casting rolls 12, which is to say the speed of casting, can be increased and the productivity of strip S can be raised.

Figure 3:
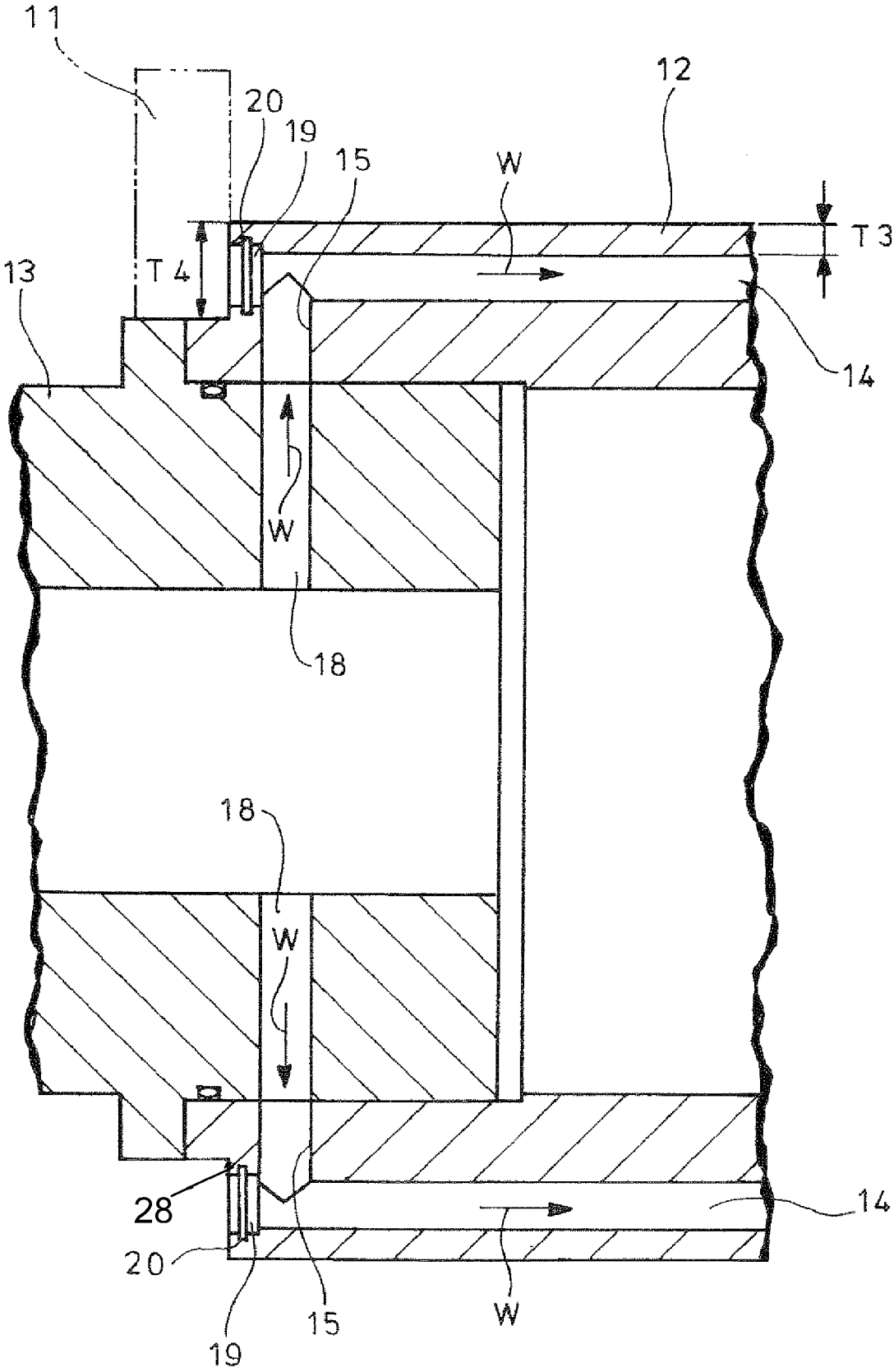
FIG. 3 is a schematic drawing showing a vertical cross section of a further embodiment of a continuous casting machine.

FIG. 3 is a second example of a continuous casting machine with similar casting rolls as shown in FIG. 1, and the same symbols in the drawings represent the same parts as in FIG. 1 and FIG. 2.

In this embodiment, disc-shaped plugs 19 may engage each end of the longitudinal cooling channels 14, such that the radial cooling channels 15 communicate with the longitudinal cooling channels 14 in place of the plugs 16 described above.

The plugs 19 are fixed to the casting rolls 12 by snap rings 20, sealing members such as O rings and the like are inserted between the plugs 19 and the inner circumferential surfaces of the longitudinal cooling channels 14. Cooling water W flows continuously in sequence through the first radial cooling channel 15, the longitudinal cooling channel 14 and then into the other radial cooling channel 15 connected with the longitudinal cooling channel 14.

The continuous casting machine employing the casting rolls described above efficiently removes heat from the casting rolls 12 through the cooling water W that flows into the radial cooling channels 15 and the longitudinal cooling channels 14, while the molten metal is poured into the space above the nip formed by the side dams 11 and the casting rolls 12.

The longitudinal cooling channels 14 extend from the first end surface 28 of the casting rolls 12 that may be in contact with the first side dams 11 to the second end surface 28 of the casting rolls 12 that may be in contact with the second side dams 11. It is therefore possible to reduce the gap T3 between the longitudinal cooling channels 14 and the outer circumferential surfaces of the casting rolls 12, while maintaining the level of contact T4 of the side dams 11 with the end surfaces 28 of the portions of casting rolls 12 at the shoulder portion.

Consequently, the cooling water W passes through the longitudinal channels of the casting rolls 12, and effectively cools the outer circumferential surfaces of the casting rolls 12.

Furthermore, an embodiment is provided where the cooling water W flows into the ends of the longitudinal cooling channels 14 via radial cooling channels 15 from the inner circumferential surfaces of the casting rolls to the longitudinal cooling channels 14 near the end surfaces 28 of the central portions of the casting rolls 12. Therefore, the outer circumferential surfaces at the end portions of the casting rolls 12 are more efficiently cooled.

In this manner, in the casting rolls shown in FIG. 3, the temperature of the outer circumferential surfaces of the casting rolls 12 are reduced, and the speed of the casting rolls 12, which is to say the speed of casting, can be increased and the productivity of strip S (see FIG. 2) can be raised.

Figure 4:
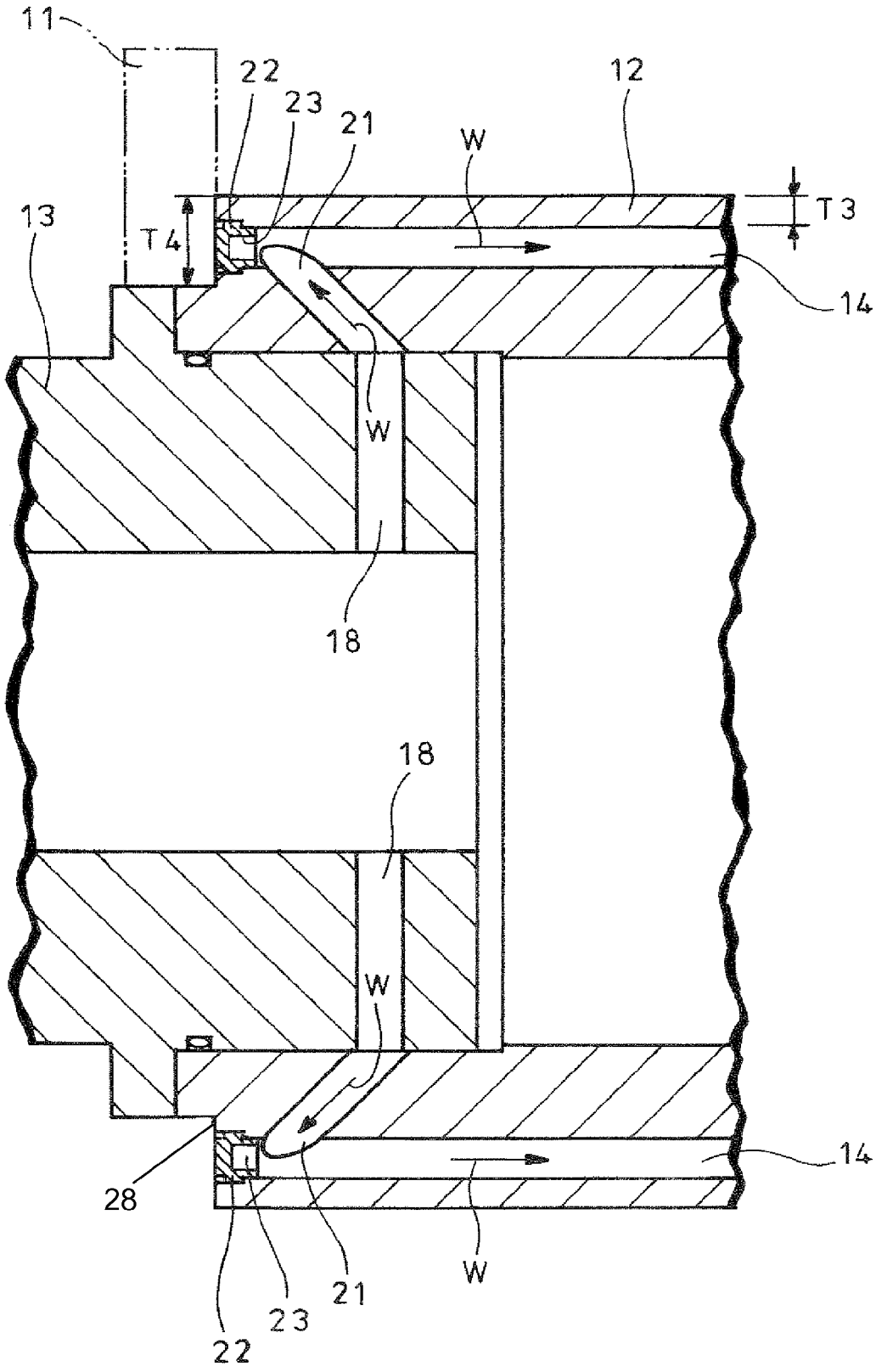
FIG. 4 is a schematic drawing showing a vertical cross section of an additional embodiment of a continuous casting machine.
Figure 5:
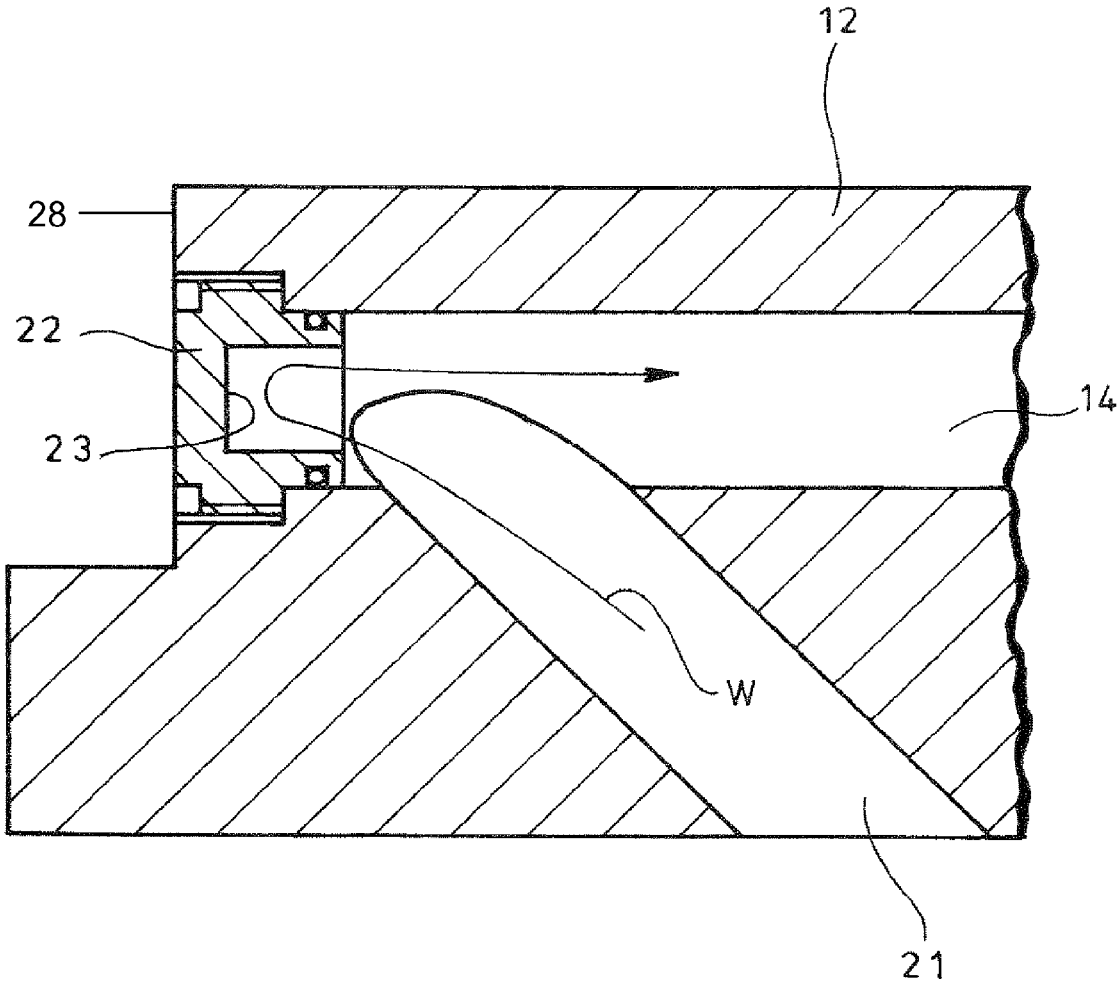
FIG. 5 is a schematic drawing showing the relative positions of the longitudinal cooling channels, radial cooling channels and plugs shown in FIG. 4.
Figure 6:
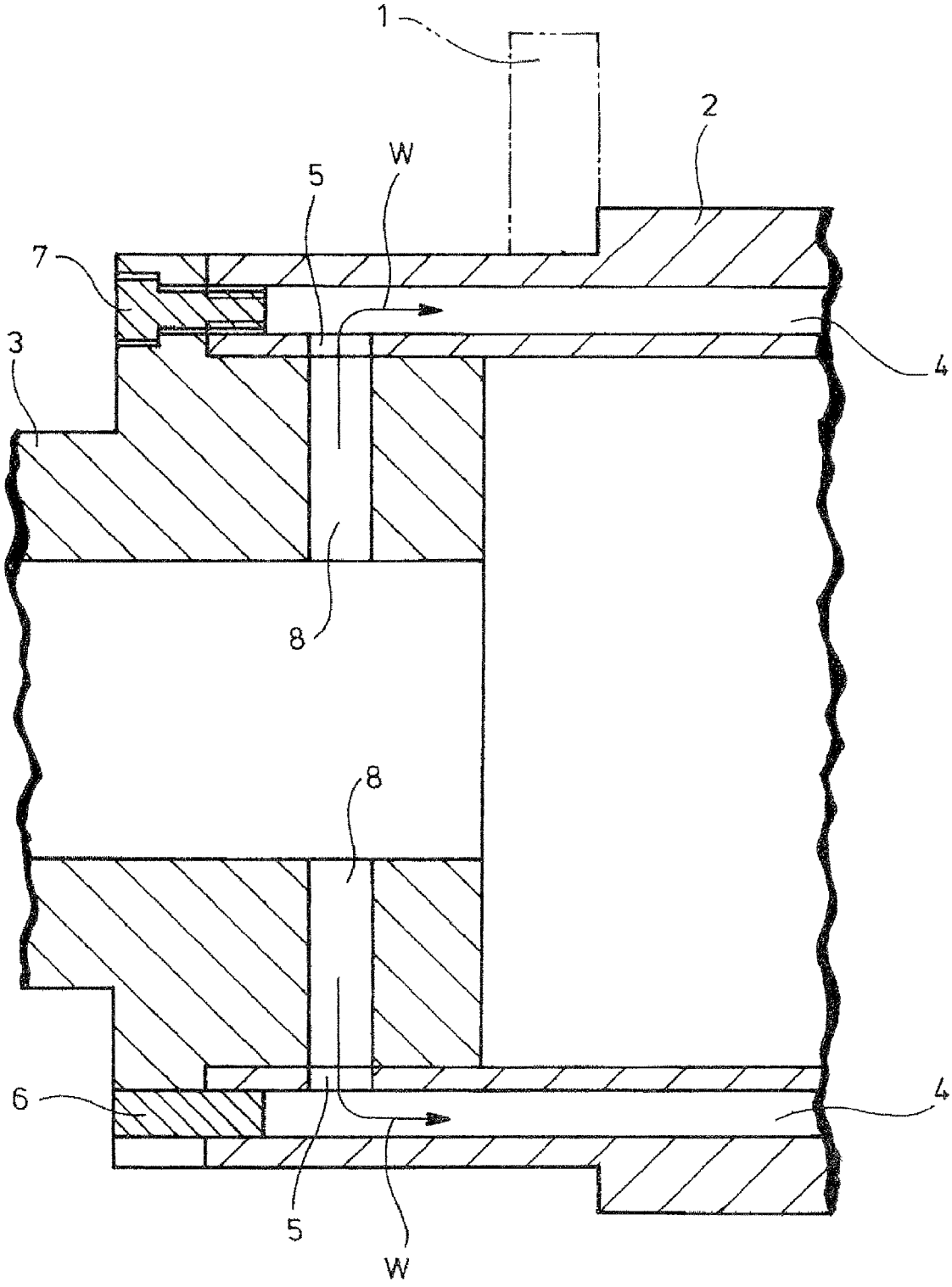
Figure 6 Prior Art
FIG. 6 is a schematic drawing showing a vertical cross section of a prior art continuous casting machine.
Figure 7:
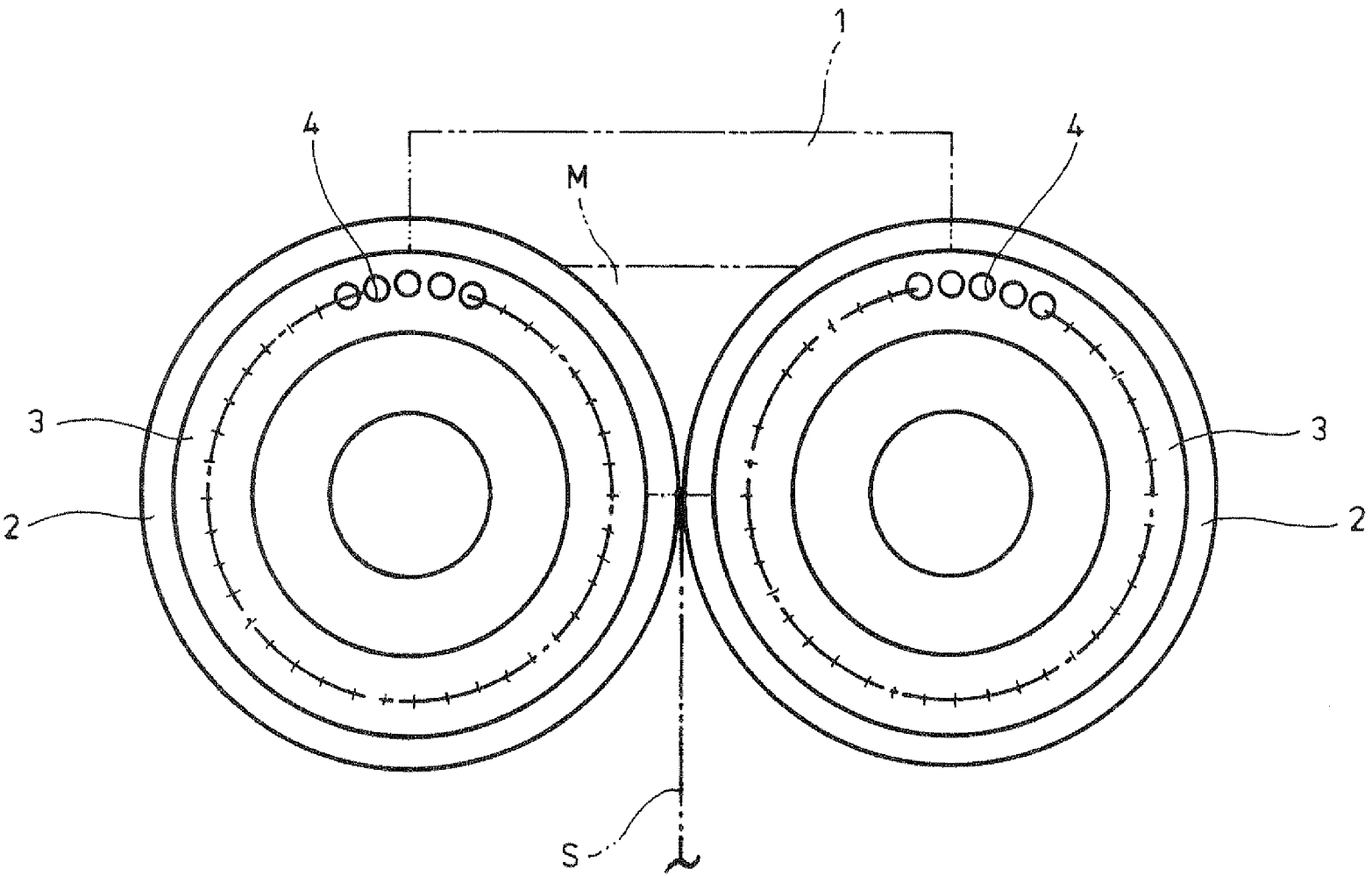
Figure 7 Prior Art
FIG. 7 is a schematic drawing showing an axial view of the casting rolls and stub shafts of the prior art continuous casting machine shown in FIG. 6.

FIG. 4 and FIG. 5 are a third example of a continuous casting machine that employs the disclosed casting rolls, and the same symbols in the drawings represent the same parts as in FIGS. 1 to 3.

Longitudinal cooling channels 14 extend through the casting rolls 12 from one end surface 28 that may contact the side dam 11 to the other end surface 28 that may also contact the other side dam 11. Radial cooling channels 21 extend radially from the inner circumferential surface of the casting rolls towards outer diameter of the central portion of the casting rolls 12 and connect with the longitudinal cooling channels 14.

The longitudinal cooling channels 14 may be disposed substantially equidistantly circumferentially in the casting roll 12, and the radial cooling channels 21 may extend radially in relation to the center portion of the casting roll 12.

Furthermore, plugs 22 engage both ends of the longitudinal cooling channels 14, and have concave hollowed out parts 23 that face towards the centers of the longitudinal cooling channels 14 formed in the end surfaces of the plugs 22.

The outer circumferential surfaces of the end portions of the plugs 22 are threaded to screw into corresponding threads in the inner circumferential surfaces of the longitudinal cooling channels 14. O rings or other sealing materials may also used to seal plugs 22 to cooling channels 14.

Plugs 22 may be coated with heat-conducting grease such that the heat-conducting grease is interposed between the outer side surfaces of the plugs 22 and the inner side surfaces of the longitudinal cooling channels 14 that face towards the plugs.

In the continuous caster employing the novel casting rolls described above, cooling water W flows through the radial cooling channels 21 and into the longitudinal cooling channels 14, which extracts heat from the casting rolls 12 as the molten metal is poured into the space enclosed by the side dams 11 and the casting rolls 12.

The longitudinal cooling channels 14 extend from the first end surfaces 28 of the casting rolls 12 at the shoulder portions, adjacent the first side dams 11, to the second end surfaces 28 of the casting rolls 12 at the opposite shoulder portion, adjacent the second side dams 11. Therefore, it is possible to reduce the gap T3 between the longitudinal cooling channels 14 and the outer circumferential surfaces of the casting rolls 12, while maintaining the desired level of contact T4 of the side dams 11 with the end surfaces 28 of casting rolls 12.

Thus the cooling water W passes through the longitudinal channel near the surface layer parts of the casting rolls 12, and effectively cools the outer circumferential surfaces of the casting rolls 12.

Furthermore, an embodiment is provided in which the radial cooling channels 21 extend such that cooling channels 21 communicate obliquely with hollowed out parts 23 formed in the leading end surfaces of the plugs 22, so that the cooling water W is conducted into and out of the hollowed out parts of the plugs 22 causing more efficient cooling of the end portions of the outer circumferential surfaces of the casting rolls 12. To further improve the removal of heat, heat conducting grease may be used between the outer side surfaces of the plugs 22 and the inner side surfaces of the longitudinal cooling channels 14.

Due to the increased cooling effect on the outer circumferential surfaces of the casting rolls 12 in the casting rolls shown in FIG. 4 and FIG. 5, the speed of the casting rolls 12, that is to say, the casting speed can be increased and the productivity of the strip S (see FIG. 2) can be raised.

The generality of the casting rolls as claimed herein are not limited to the modes of implementation described above, and naturally modifications may be made thereto provided only that they do not breach the spirit of the invention.

The casting rolls disclosed herein may be employed for the continuous casting of various metals such as steel in particular.

What is claimed is:

1. An apparatus for casting metal strip comprising:

a pair of laterally positioned casting rolls forming a nip between them, each casting roll comprising a cylindrical body with two end portions, each adapted to engage a stub shaft, a central portion between the two end portions, a cylindrical shoulder portion at each end of the central portion adapted to support a side dam, and a plurality of longitudinal cooling passages extending through the central portion and into the cylindrical shoulders, the longitudinal cooling passages being closed by plugs therein;

a molten metal supply system to deliver molten metal above the nip between the casting rolls to form a casting pool of molten metal supported on the casting rolls immediately above the nip confined by side dams positioned adjacent the shoulder portion.

2. The apparatus for casting metal strip of claim 1 where each casting roll has a plurality of radial cooling passages therein, each radial cooling passage extending from a casting roll inner periphery to a longitudinal cooling passage.

3. The apparatus for casting metal strip of claim 2 where the plugs have a side aperture in a side surface thereof, the radial cooling passages extending to the plug side apertures.

4. The apparatus for casting metal strip of claim 1 where the plugs have a closed end and a hollow interior open to the longitudinal cooling passages.

5. The apparatus for casting metal strip of claim 1 where the plugs have a closed end and an open interior.

6. The apparatus for casting metal strip of claim 1 wherein the plugs are threaded and threadedly engage the longitudinal cooling passages.

7. The apparatus for casting metal strip of claim 1 where the plugs are disked-shaped.

8. The apparatus for casting metal strip of claim 1 where the plugs include snap-rings retaining the plugs in the longitudinal cooling passages.

9. The apparatus for casting metal strip of claim 1 where outer side surfaces of the plugs have heat-conduction grease thereon.

10. The apparatus for casting metal strip of claim 1 where each end of each longitudinal cooling passage terminates in an aperture in one of the shoulder portions.

11. The apparatus for casting metal strip of claim 1 further comprising a hollow stub shaft axially engaging one end portion of the cylindrical body where the hollow stub shaft has an outer diameter similar to an outer diameter of the cylindrical body at the end portion.

12. A casting roll comprising:

a stepped cylindrical body having a central portion with a first outer diameter and an end portion having a second outer diameter extending axially from each end of the cylindrical central portion, the end portion adapted to engage a stub shaft, the second outer diameter being smaller than the first outer diameter, each end of the cylindrical central portion having a radially extending end surface between the first outer diameter and the second outer diameter, each radially extending end surface having a plurality of circumferentially spaced cooling apertures therein;

a plurality of longitudinal cooling passages extending through the cylindrical central portion, each longitudinal cooling passage terminating in a cooling aperture in the radially extending end surfaces;

an enclosure fitting into each cooling aperture; and each radially extending end surface with the plurality of cooling apertures therein adapted to engage a pool confining end closure.

13. The casting roll of claim 12 where each casting roll comprises a plurality of radial cooling passages therein, each radial cooling passage extending from a casting roll inner periphery to a longitudinal cooling passage.

14. The casting roll of claim 12 where a portion of the radial cooling passages extends axially towards the longitudinal cooling passages.

15. The casting roll of claim 14 where the enclosures have a closed end and a hollow interior open to the longitudinal cooling passages.

16. The casting roll of claim 15 where the enclosures have a side aperture in a side surface thereof, the radial cooling passages extending to the enclosure side apertures.

17. The casting roll of claim 12 where the enclosures have a closed end and an open interior.

18. The casting roll of claim 12 wherein the enclosures are threaded and threadedly engage the longitudinal cooling passages.

19. The casting roll of claim 12 where the enclosures are disked-shaped.

20. The casting roll of claim 12 where the enclosures include snap-rings retaining the enclosures in the longitudinal cooling passages.

21. The casting roll of claim 12 where outer side surfaces of the enclosures have heat-conduction grease thereon.

22. The casting roll of claim 12 where each end of each longitudinal cooling passage terminates in an aperture in one of the radially extending end surfaces.

23. The casting roll of claim 12 further comprising a hollow stub shaft axially engaging the end portion of the stepped cylindrical body where the hollow stub shaft has a third outer diameter similar to the second outer diameter of the end portion.

24. A method of continuously casting thin metal strip comprising the steps of:

assembling a pair of laterally positioned casting rolls forming a nip between them, each casting roll comprising a cylindrical body with two end portions, each adapted to engage a stub shaft, a central portion between the two end portions, a cylindrical shoulder portion at each end of the central portion adapted to support a side dam, and a plurality of longitudinal cooling passages extending through the central portion and into the cylindrical shoulder portions, the longitudinal cooling passages being closed by plugs therein;

delivering molten metal through a metal supply system above the nip between the casting rolls to form a casting pool of molten metal supported on the casting rolls immediately above the nip confined by side dams positioned adjacent the shoulder portion;

counter rotating the casting rolls to form shells from the casting pool on the cylindrical surfaces of the casting rolls and form thin cast strip at the nip between the casting rolls delivered downwardly.

25. The method of continuously casting thin metal strip of claim 24 where each casting roll further comprises a hollow stub shaft axially engaging one end portion of the cylindrical body where the hollow stub shaft has an outer diameter similar to an outer diameter of the cylindrical body at the end portion.

* * * * *